United States Patent [19]

Wynn

[11] 4,160,630

[45] Jul. 10, 1979

[54] GEAR PUMPS WITH LOW PRESSURE SHAFT LUBRICATION

[75] Inventor: Barry Wynn, Tarrant Gunville, England

[73] Assignee: General Signal Corporation, Stamford, Conn.

[21] Appl. No.: 873,650

[22] Filed: Jan. 30, 1978

[30] Foreign Application Priority Data

Feb. 1, 1977 [GB] United Kingdom ..... 3999/77

[51] Int. Cl.[2] ..... F04C 15/00

[52] U.S. Cl. ..... 418/102

[58] Field of Search ..... 418/75, 78, 102, 131, 418/132

[56] References Cited

U.S. PATENT DOCUMENTS

| | | | |
|---|---|---|---|
| 2,885,965 | 5/1959 | Haberland | 418/102 X |
| 3,447,472 | 6/1969 | Hodges et al. | 418/102 X |
| 3,490,382 | 1/1970 | Joyner | 418/102 |
| 3,528,756 | 9/1970 | Norlin et al. | 418/102 X |
| 3,690,793 | 9/1972 | Pollman et al. | 418/102 |
| 3,909,165 | 9/1975 | Laumont | 418/102 |
| 4,090,820 | 5/1978 | Teruyama | 418/102 |

FOREIGN PATENT DOCUMENTS

| | | | |
|---|---|---|---|
| 1386237 | 3/1975 | United Kingdom | 418/102 |

*Primary Examiner*—Carlton R. Croyle
*Assistant Examiner*—Leonard E. Smith
*Attorney, Agent, or Firm*—Jeffrey S. Mednick

[57] ABSTRACT

An improved gear pump includes seal plates having lubrication channels communicating between the low pressure side of the zone where the gear teeth intermesh and the shaft bearings. Lubricant flow is directed first through one bearing on one side of the pump and then back through the other bearing on that side to the pump inlet chamber. Placement of the lubrication channels on the low pressure side of the pump where the volume between intermeshing teeth is increasing ensures that flow reversals in the bearings and lubricant aeration are avoided; and renders bearing flow rate less sensitive to pressure so that relatively large flow channels may be used in the wear plate.

5 Claims, 4 Drawing Figures

GEAR PUMPS WITH LOW PRESSURE SHAFT LUBRICATION

BACKGROUND OF THE INVENTION

Various attempts have been made in the past to provide adequate lubrication for the bearings of spur gear pumps by bleeding off a portion of the fluid flowing through the pump and passing this portion through the pump bearings. For example, the pump wear plates have been provided with a metering slot extending between the shaft openings of the wear plate, in the zone where the gear teeth intermesh. In such a case, lubricant is forced in parallel via the metering slot through the bearings and then collected and returned to the pump inlet chamber. These long metering slots have the disadvantage that they weaken the seal plate so that high strength, expensive materials must be used. Also, the metering slots or notches are subject to both clogging and erosion which can seriously impair the distribution of lubricant. Moreover, air dissolved in the lubricant tends to be pulled out during flow through the metering notches, which leads to frothing of the lubricant and poor flow through the bearings. Finally, such parallel lubrication of the bearings requires rather large volumes of oil which do not reach the outlet port of the pump, thereby reducing overall efficiency.

Attempts have also been made to direct lubricant flow in series first to one bearing and then to the other, to reduce the overall volume of oil required for bearing lubrication. For example, it is known to provide a short metering slot which extends from the zone where the gear teeth intermesh toward only one of the gear shafts, on the high pressure side of the pump. In this case, lubricant is forced in series through one bearing via the short metering slot, through a channel in the pump housing to the other bearing, and then returned to the pump inlet chamber. Unfortunately, this prior art design is subject to several of the drawbacks noted previously for the parallel flow pump. Location of the metering slot on the high pressure side of the pump requires the use of a carefully sized slot to keep the bearing flow rates within limits as discharge pressure varies under load. Thus, the bearing flow is controlled by the system pressure and is difficult to regulate. Moreover, the metering slot is still subject to clogging and erosion due to its rather small size. As the volume between the gear teeth first decreases and then increases in such prior art designs, flow reversals are known to occur in the metering slot which can lead to less desirable lubricant flow patterns and lubricant frothing. Finally, location of the short metering slot on the high pressure side of the pump places a large pressure differential on the wear plate which tends to cause increased wear.

OBJECTS OF THE INVENTION

An object of the invention is to provide a gear pump having an improved wear plate, by means of which lubricant flow is directed in series through adjacent gear shaft bearings.

Another object of the invention is to provide such a pump with a wear plate having a flow channel for lubricant which extends from the zone of intermeshing teeth on the low pressure side of the pump.

A further object of the invention is to provide such a pump with a wear plate having a lubricant flow channel which is offset from the center portion of the wear plate between the gear shaft opening, whereby wear plate strength is improved.

Yet another object of the invention is to provide such a pump having a wear plate in which the lubricant flow channels are enlarged to reduce aeration of the flowing lubricant.

A still further object of the invention is to provide such a pump in which the pressure drop across the wear plate due to lubricant flow therethrough is reduced to provide enhanced wear plate life.

Still another object of the invention is to provide such a pump with a wear plate having lubricant flow channels located relative to the zone of intermeshing gear teeth so that flow reversals in the channels are avoided.

These objects are given only by way of example. Thus, other desirable objects and advantages inherently achieved by the disclosed invention may be apparent to those skilled in the art. Nonetheless, the scope of the invention is to be limited only by the appended claims.

SUMMARY OF THE INVENTION

The above objects and other advantages are achieved by the disclosed invention. In one embodiment, the invention includes a pump housing having a pair of shafts mounted on bearings for rotation in the housing. Intermeshing gears are mounted on the shafts and floating wear plates are mounted on either side of the gears between the gears and the shaft bearings. Lubricant flow channels are provided in the wear plates which originate adjacent to the zone of intermeshing of the pump gears, at a location in which the channels are open to receive fluid from the volume trapped between the intermeshing gears only when the volume is increasing, thereby avoiding flow reversals. Flow from the channels passes through one shaft bearing on each side of the gears, through a passage in the housing and back through the adjacent bearing to the inlet chamber of the pump. The wear plates include a second slot on the side facing the bearings, which communicates with the inlet chamber.

DETAILED DESCRIPTION OF THE PREFERRED EMBODIMENT

Figure 4:
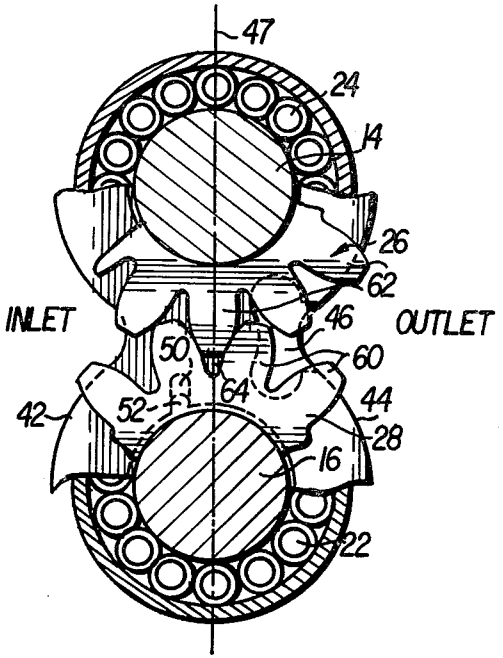
FIG. 4 shows a section, partially broken away, taken along line 4—4 of FIG. 1, indicating the cooperation between the gear teeth and the lubrication channels in the wear plate and the location of the lubricaton channels relative to the gear teeth and the pump inlet.

There follows a detailed description of the preferred embodiment of the invention, reference being had to the drawing in which like reference numerals identify like elements of structure in each of the several Figures.

Figure 1:
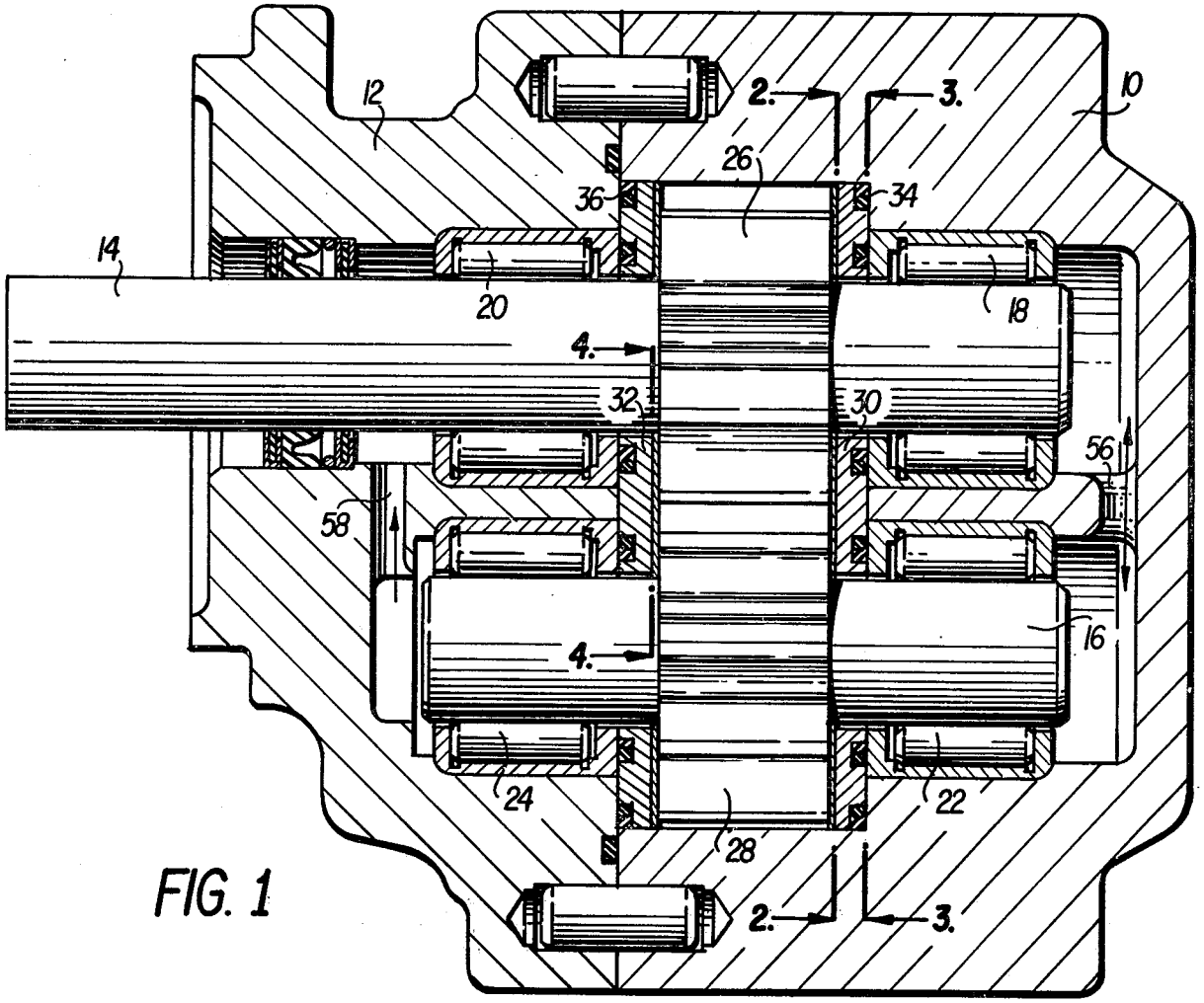
FIG. 1 shows an elevation section through a gear pump embodying the invention.

FIG. 1 shows an elevation section through a gear pump embodying the invention. A housing 10 and closure or adapter 12 support a pair of parallel shafts, a drive shaft 14 and a driven shaft 16, via shaft roller bearings 18, 20, 22 and 24. A drive gear 26, mounted for rotation with drive shaft 14, meshes with a driven gear 28 mounted for rotation with driven shaft 16. Between the gears 26, 28 and housing 10, a wear plate 30 is provided which bears against a ledge in housing 10 in the conventional manner. Similarly, a wear plate 32 is provided between gears 26, 28 and closure 12. W-shaped seals 34 and 36, of known design, are provided in grooves in wear plates 30 and 32 to seal the pump inlet chamber from the outlet chamber. See also FIG. 3.

Figure 2:
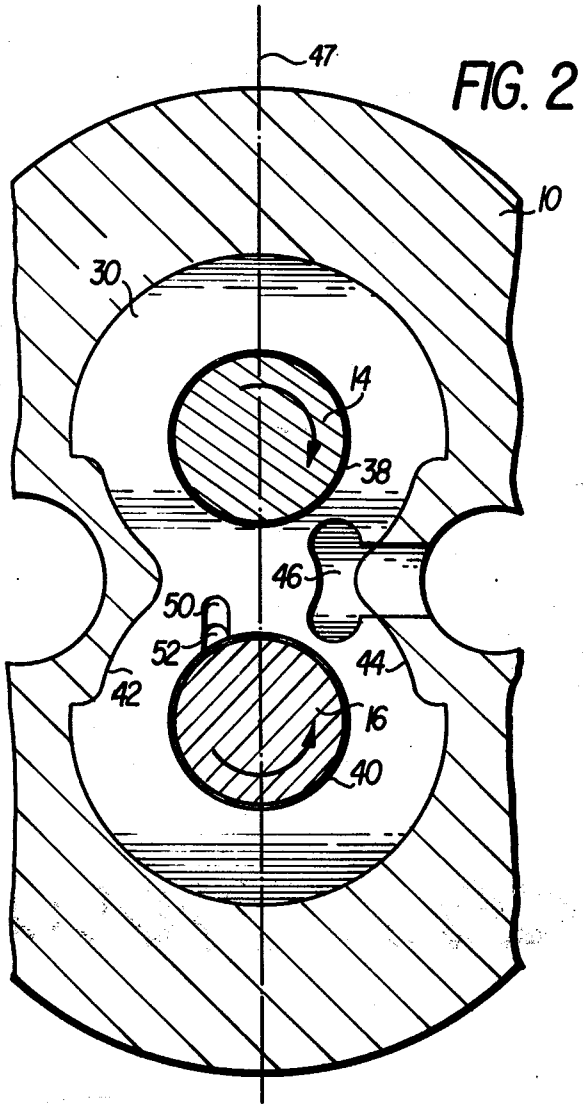
FIG. 2 shows a section taken along line 2—2 of FIG. 1, indicating the details of the gear side of the seal plate.

Referring to FIG. 2, the gear side of wear plate 30 is seen to have a generally 8-shaped configuration. Plate 30 may be of aluminum or other suitable material and includes a pair of spaced bores 38, 40 through which shafts 14 and 16 extend, respectively. An inlet port relief 42 is cut away on the inlet chamber side of the plate; and an outlet port relief 44 on the outlet chamber side. A pressure relief slot 46 is machined into the surface of plate 30 in position to permit pressure equalization between the fluid trapped between intermeshing gear teeth and the fluid in the outlet chamber, as the gear teeth begin to mesh. This prevents the generation of excessively high pressures in the volume between the gear teeth in the zone of intermeshing teeth located between the inlet and outlet chambers, in the familiar manner.

On the inlet chamber side of a line 47 extending between the centers of bores 38 and 40, a lubricant flow channel 48 is provided which includes a recess portion 50 cut into the face of plate 30. Portion 50 extends toward bore 40 in a direction generally parallel to line 47 and intersects a notch 52 which extends essentially axially through the thickness of plate 30. Notch 52 is positioned to direct lubricant into the roller and cage area of the adjacent bearing 22. The specific location of recess portion 50 and notch 52 is discussed hereinafter with respect to FIG 4.

Figure 3:
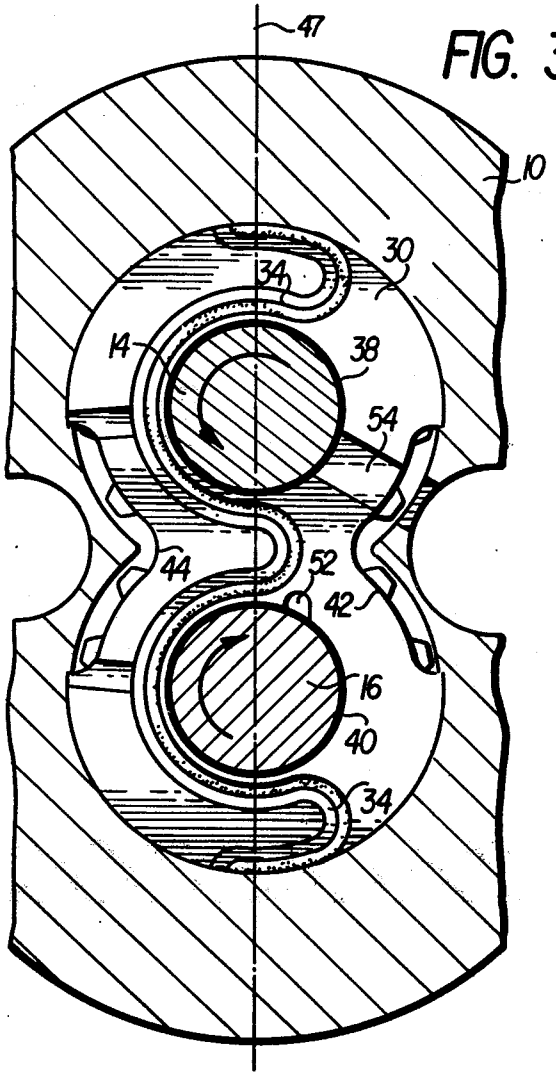
FIG. 3 shows a section taken along line 3—3 of FIG. 1, indicating the details of the bearing side of the seal plate.

FIG. 3 shows the bearing side of wear plate 30, which includes a slot 54 which extends from bore 38 outwardly to communicate with the inlet chamber of the pump. The configuration of W-seal 34 permits isolation of the inlet and outlet chambers except for the small amount of fluid carried through the intermeshing zone between the gear teeth from inlet to outlet. In operation, fluid is carried between the gear teeth to recess 50 from which it flows through notch 52 and driven bearing 22; a passage 56, 58 is provided in housing 10 or closure 12 depending on the side of the pump in question; back through bearing 18; through slot 54 and into the inlet chamber of the pump. In the illustrated embodiment, wear plate 32 is a mirror image of plate 30. Because the driven bearings 22, 24 are more heavily loaded, lubricant preferably is directed through them first, as shown; however, lubricant may also be directed first through bearings 18, 20 without departing from the invention.

FIG. 4 shows a fragmentary view of a pump embodying the invention, particularly the location of recess 50 and notch 52 relative to gears 26, 28 and inlet port relief 42. As gears 26 and 28 begin to intermesh, a small amount of fluid is trapped between teeth 60 and 62 in volume 64. Initially, volume 64, or the gear "backlash" as it is called, is decreasing in size as the teeth continue to mesh, thereby compressing the small amount of fluid trapped therein and raising the pressure in volume 64. As previously mentioned, relief slot 46 initially prevents this pressure from reaching excessive levels when the gears begin to mesh. As the gears continue to mesh, volume 64 will eventually begin to increase in size as it moves past center line 47. Due to the change in volume 64 as the gears turn, the pressure in volume will rise rapidly to a peak value when the volume is smallest and then fall rapidly as the volume expands. Recess portion 50 is located according to the invention on the inlet side of line 47 so that it is exposed to each successive volume 64 as that volume is increasing and as the pressure in that volume is dropping. The exact location of recess portion 50 will vary somewhat with tooth geometry; however, it has been sucessfully placed up to two gear pitches away from line 47. Until the volume 64 opens to the inlet chamber as the enclosing teeth separate or as the enclosing teeth pass the edge of inlet port relief 42, the pressure in the volume 64 will be greater than the inlet pressure of the pump. Thus, the necessary pressure differential is provided to force fluid through notch 52 into bearing 22 and on through bearing 30, in the manner previously described.

Placement of recess portion 50 on the inlet side of line 47 is important to the operation of the invention. If recess 50 were placed on the outlet side of the pump above line 47, it would be subjected to substantially higher pressures. To keep the flow rates through the bearings within reasonable limits at these high pressures, the recess would have to be made rather small to meter the flow. As mentioned previously, such an arrangement is susceptible to clogging, erosion and aeration problems. On the other hand, if the recess were placed so that it was exposed to volume 64 as the volume displacement rapidly increased, reached a maximum and then rapidly decreased, it would be subjected to a series of short pressure transients or spikes. Such variations lead to corresponding up and down fluctuations in flow rate through the bearings, which are thought to cause flow reversals of the lubricant and aeration.

However, when recess portion 50 is located on the low pressure side of line 47, as in the present invention, various advantages result. Since the pressure in volume 64 is relatively low at this location, portion 50 and notch 52 need not be small to meter the flow, with the result that the wear plate is less sensitive to erosion and clogging. The successive volumes 64 thus become the only effective means to meter the flow into the bearings. Since the pressure in volume 64 is dropping steadily, undesirable flow reversals and aeration are substantially avoided. Also, the lower pressure at the inlet of notch 52 means a smaller pressure differential across the wear plate, which reduces wear. In addition, although the underlying causes are not fully understood, the location of slot 54 on the bearing side of the wear plate, rather than the gear side, has been found to reduce aeration in the lubricant.

Having described my invention in sufficient detail to enable those skilled in the art to make and use it, I claim:

1. An improved rotary gear pump comprising:

a housing having an inlet and an outlet chamber;

a pair of shafts mounted for rotation in said housing on bearings supported by said housing;

a pair of gears, one mounted on each of said shafts, said gears having gear teeth intermeshing at a zone located between said inlet chamber and said outlet chamber; said gear teeth sequentially enclosing volumes of fluid therebetween as said gears intermesh in said zone;

at least one seal plate located between said bearings and said gears with said shafts extending through said seal plate;

channel means in said seal plate, originating adjacent to said zone at a location in which said channel means is open to receive fluid from said volumes between said intermeshing teeth only while said volumes are increasing, for directing fluid from said zone through one of the bearings adjacent said seal plate;

means for receiving fluid from said one bearing and directing it through the other bearing on the adjacent shaft; and means for receiving fluid from said other bearing and returning it to said inlet chamber.

2. A pump according to claim 1, wherein said channel means comprises a first slot in the side of said seal plate facing said gears, said slot extending inwardly from said location essentially toward the center of said one bearing; and a second slot communicating with said first slot and extending essentially axially toward said one bearing.

3. A pump according to claim 1, wherein said means for receiving fluid comprises a slot in the side of said seal plate facing said other bearing, said slot extending from the location of said bearing toward said inlet chamber.

4. A pump according to claim 1, wherein said channel means is located on the inlet chamber side of a line extending between the centers of said shafts.

5. A pump according to claim 1, further comprising pressure relief slot means in said seal plate, communicating with said outlet chamber, for relieving pressure in said volumes between intermeshing teeth as said gears rotate past said pressure relief slot means.

* * * * *